US005770994A

United States Patent [19]

Evans

[11] Patent Number: 5,770,994

[45] Date of Patent: Jun. 23, 1998

[54] FUSE ELEMENT FOR AN OVERCURRENT PROTECTION DEVICE

[75] Inventor: Terence John Evans, Ballwin, Mo.

[73] Assignee: Cooper Industries, Inc., Houston, Tex.

[21] Appl. No.: 552,087

[22] Filed: Nov. 2, 1995

[51] Int. Cl.[6] ..... H01H 85/04

[52] U.S. Cl. ..... 337/295; 337/159; 337/273; 337/290

[58] Field of Search ..... 337/159, 295, 337/273, 290–296

[56] References Cited

U.S. PATENT DOCUMENTS

| | | | |
|---|---|---|---|
| 4,017,817 | 4/1977 | Ranzanigo | 337/290 |
| 4,101,860 | 7/1978 | Fister | 337/159 |
| 4,118,684 | 10/1978 | Mollenhoff | 337/296 |
| 4,150,354 | 4/1979 | Namitokov et al. | 337/290 |
| 4,204,184 | 5/1980 | Csizy et al. | 337/295 |
| 4,511,874 | 4/1985 | Rasmussen et al. | 337/159 |
| 4,689,598 | 8/1987 | Ishikawa et al. | 337/295 |
| 4,855,705 | 8/1989 | Narancic et al. | 337/246 |
| 5,262,750 | 11/1993 | Gurevich | 337/273 |
| 5,432,378 | 7/1995 | Whitney et al. | 337/297 X |

*Primary Examiner*—Leo P. Picard
*Assistant Examiner*—Jayprakash N. Gandhi
*Attorney, Agent, or Firm*—Burns, Doane, Swecker & Mathis LLP

[57] ABSTRACT

A fuse element having a substantially planar strip formed of an electrically conductive metal having a central portion and opposite end portions. The central portion is provided with a plurality of diamond-shaped perforations. The perforations form a plurality of branches that define a plurality of elongated, narrowed electrical pathways across the central portion. The joints where the branches meet form the weak spots for the fuse element. The central portion of the fuse element is encased in a material that is electrically non-conducting and heat conducting. The material, a ceramic, for example, is injection molded in and around the perforations to substantially completely encase the central portion of the fuse element.

16 Claims, 3 Drawing Sheets

FUSE ELEMENT FOR AN OVERCURRENT PROTECTION DEVICE

FIELD OF THE INVENTION

The present invention relates to an overcurrent protection device. More particularly, the present invention relates to an overcurrent protection device for use with direct current power, for example, battery-powered applications such as automobile electrical systems.

BACKGROUND OF THE INVENTION

In battery-powered electrical circuits, fault current is not constant over time which presents difficulties in circuit protection. As the battery discharges, the fault current decreases. When the decreasing fault current is compared to typical semi-conductor fuse time-current curves, it can be seen that the fuse blow time gets longer as the current decreases. In many cases the fault current is below the "A—A" line at interruption. In other cases, the fuse will not open because the available current stays below the time-current curve.

A difficulty arises in traction drive controllers, which are typically designed to handle loads up to 200% of normal rating. If the controller is forced to handle loads above this level, the electronics necessarily are larger and more expensive, which is undesirable from a manufacturing standpoint.

SUMMARY OF THE INVENTION

The present invention, generally, provides an overcurrent protection device for high voltage direct current circuit protection that is capable of reliably interrupting the circuit even as the fault current decreases over time.

More particularly, the present invention provides a fuse element for an overcurrent protection device that protects against faults at a constant current overload level.

An overcurrent protection device according to the invention comprises a fuse element encased in an injection molded electrically non-conducting coating that facilitates the control of operation time and arc suppression when the fuse blows.

According to another aspect of the invention, the fuse element is formed with a plurality of perforations to provide a plurality of tortuous electrical pathways through a plurality of weak spots.

An overcurrent protection device in accordance with the present invention comprises a fuse element formed of a strip of electrically conductive metal having a central portion and opposite end portions. The strip may be planar, or may be curved or bent to fit the available space in a fuse cover or other structure. The central portion is provided with a plurality of diamond-shaped perforations. The perforations define a plurality of branches that together form a plurality of elongated, narrowed electrical pathways across the central portion. Any electrical pathway defined across the central portion has a length greater than the shortest distance across the central portion. The joints where the branches meet form the weak spots for the fuse element.

The perforations are preferably diamond shaped, which results in well defined and controlled electrical pathways and weak spots. Alternatively, the perforations may be rectangular or round holes arranged in rows to be alternately offset or staggered.

According to another aspect of the invention, the central portion of the fuse element is encased in a material that is electrically non-conducting, and heat conducting. The material, a ceramic, for example, is injection molded in and around the perforations to substantially completely encase the central portion of the fuse element.

A ceramic coating material may be any electrically non-conducting ceramic such as alumina, zirconia, or boron nitride ceramic. In addition, the coating may also comprise a plastic material such as a polyurethane, polyester, melamine, or urea, for example.

The fuse element according to the invention may be incorporated in a fuse by attaching terminals at the opposite end portions for connecting the element in a circuit.

BRIEF DESCRIPTION OF THE DRAWING FIGURES

The present invention can be further understood with reference to the following description in conjunction with the appended drawings, wherein like elements are provided with the same reference numerals. In the drawings.

DETAILED DESCRIPTION OF PREFERRED EMBODIMENTS

Figure 1:
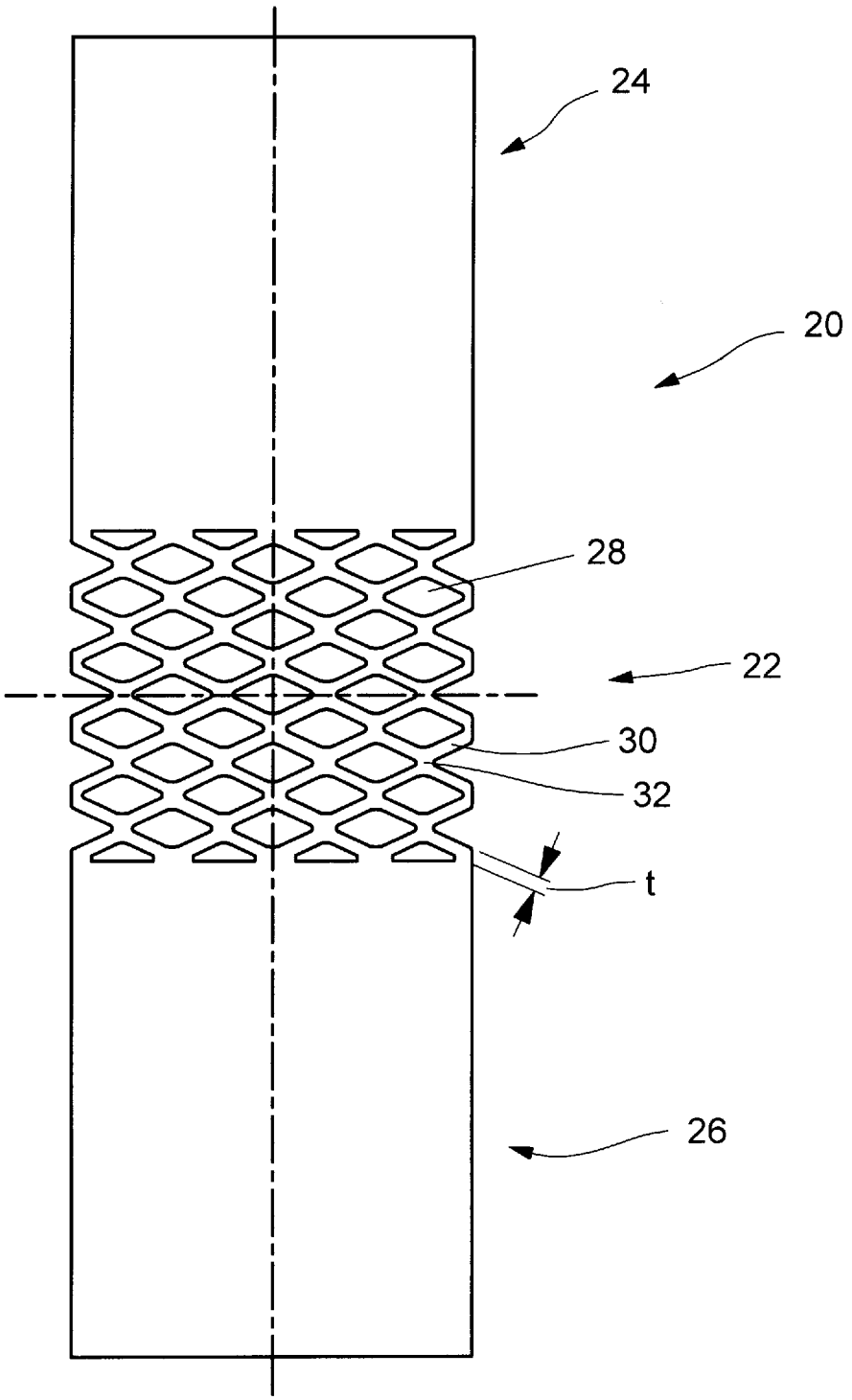
FIG. 1 is a plan view of a fuse element for a fuse in accordance with the present invention.

A fuse element 20 in accordance with a preferred embodiment of the invention is illustrated in FIG. 1. The illustrated fuse element 20 is a strip formed of an electrically conductive metal, for example, brass or aluminum. Other metals, of course, may be used. The fuse element 20 is shown as a flat or planar element, however, the strip may be curved or bent if spacing requirements dictate.

The fuse element 20 comprises a central portion 22 and opposite end portions 24, 26. The central portion 22 is provided with a plurality of diamond-shaped perforations 28 in several adjacent rows forming a lattice pattern. As may be understood with reference to the figure, the perforations 28 create a plurality of branches 30 that together form a plurality of elongated, narrowed electrical pathways across the central portion 22. An electrical pathway as used herein is defined as a continuously connected sequence of branches 30 connecting the end portions 24, 26 across the central portion 22.

The joints where the branches 30 meet form the weak spots 32 for the fuse element 20. These weak spots 32 are configured by size and shape to blow at the designed rating. As may be understood by reference to FIG. 1, an electrical pathway defined across the central portion 22 has a length greater than an axial distance across the central portion. An electrical pathway also includes a plurality of weak spots. In addition, the branches 30 comprise a smaller area of the central portion 22 than the adjacent perforations 28.

The fuse element 20 and perforations 28 may be formed by stamping, laser cutting, wire cutting or any other suitable method. The number and size of the branches 30 and weak spots 32 may be selected to provide a desired fuse rating.

The lattice configuration of branches 30 and weak spots 32 enhances high current interruption. Current traverses the central portion 22 through elongated pathways made of many individual branch elements, with current travelling in any two branches meeting at a weak spot.

Figure 2:
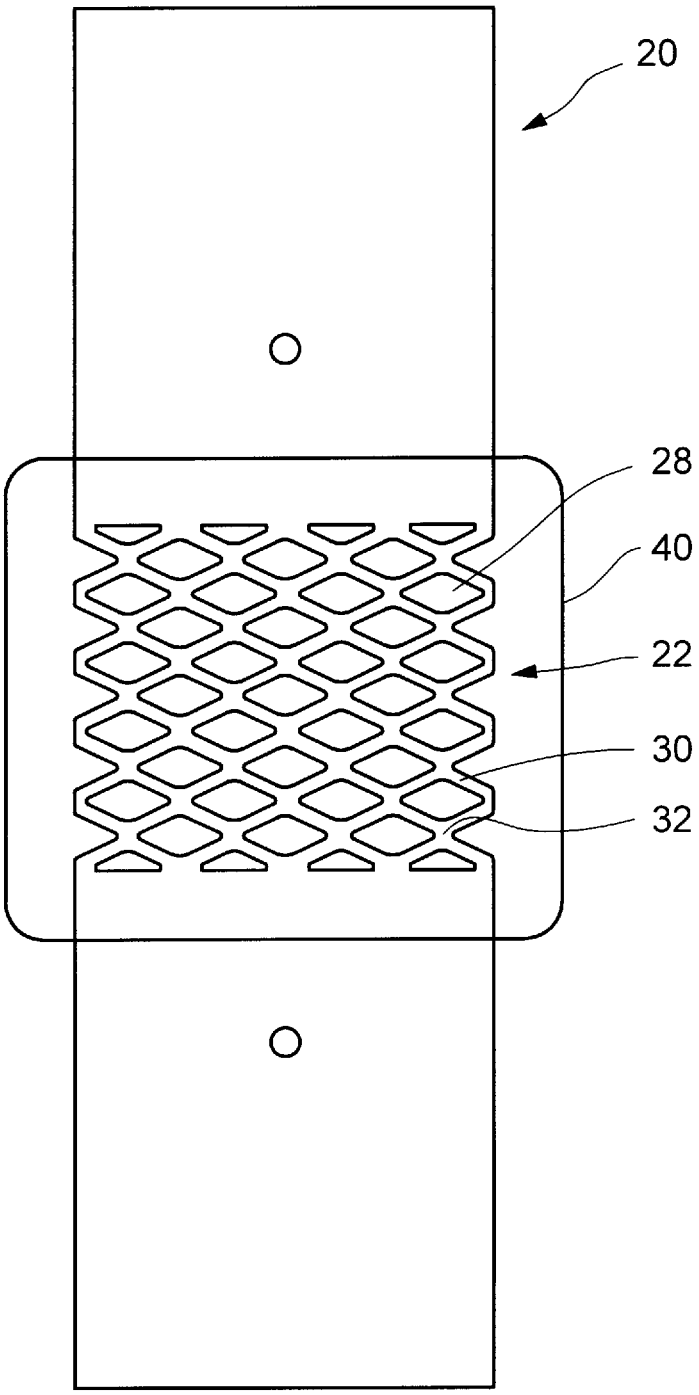
FIG. 2 is a view of the fuse element of FIG. 1 showing schematically a coating over a fusible portion.

FIG. 2 illustrates a further aspect of the invention which facilitates current interruption. As shown schematically in FIG. 2, the central portion 22 of the fuse element 20 is encased in a coating 40. According to a preferred embodiment, the coating 40 comprises an electrically non-conducting ceramic material, for example, an alumina ceramic. Other ceramic materials such as zirconia and boron nitride, would also be suitable. In addition, plastic materials such as polyurethane, polyester, melamine, urea, or other electrically non-conductive plastics are also suitable for use as the coating material.

Figure 3:
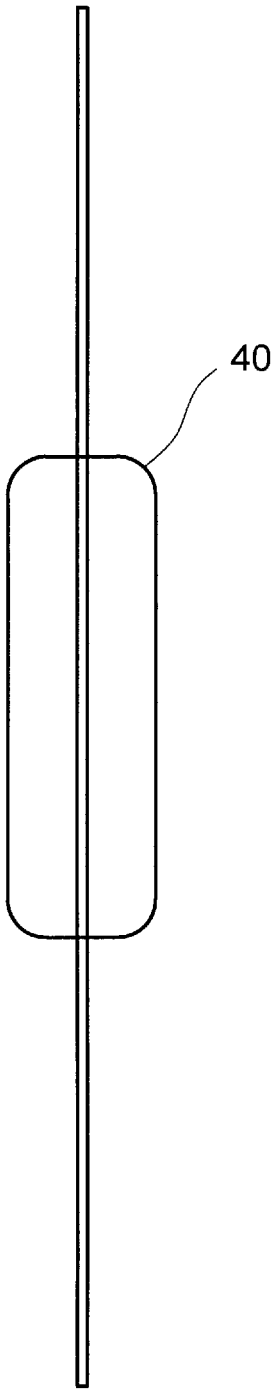
FIG. 3 is a side view of the fuse element of FIG. 2.

The coating 40 is applied to the central portion 22 so that the coating substantially completely encases the branches 32 and fills in the space in the perforations 28. As shown in FIG. 3, both sides of the fuse element 20 are encased by the coating material. The coating may be applied by injection molding, or another suitable method.

The intimate contact between the coating 40 and the branches 30 serves to transfer heat away from the branches. The low overload operating time of the fuse element is significantly increased by removing heat from the branches. The type of coating material 40 may be selected for a desired heat absorbing capacity. The low overload operation time of the fuse element may be thus adjusted.

The coating 40 also facilitates extinguishing an arc formed when the fuse blows. As mentioned, the casing serves to conduct heat from the branches. Further, by completely encasing the branches 30, the coating confines the branches 30. When the fuse blows, the pressure generated by the burned branches creates gas pressure, which is confined to the branches by the coating. High pressure environment on the branches helps to extinguish any arc formed. In addition, the elongated electrical pathways also help in extinguishing an arc.

Figure 4:
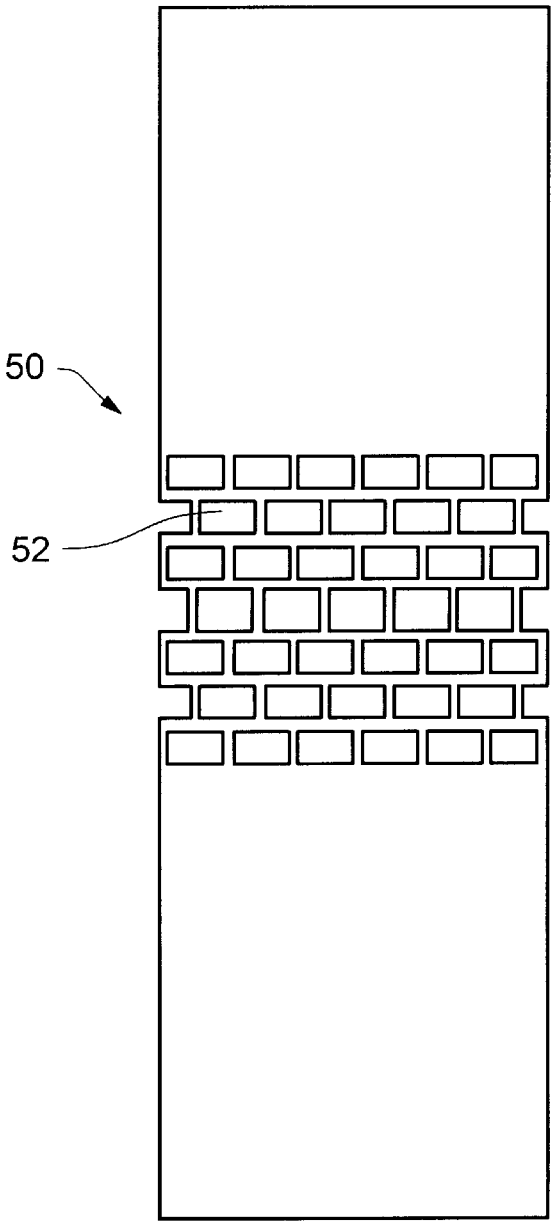
FIG. 4 is a plan view of a fuse element having an alternative perforation pattern.
Figure 5:
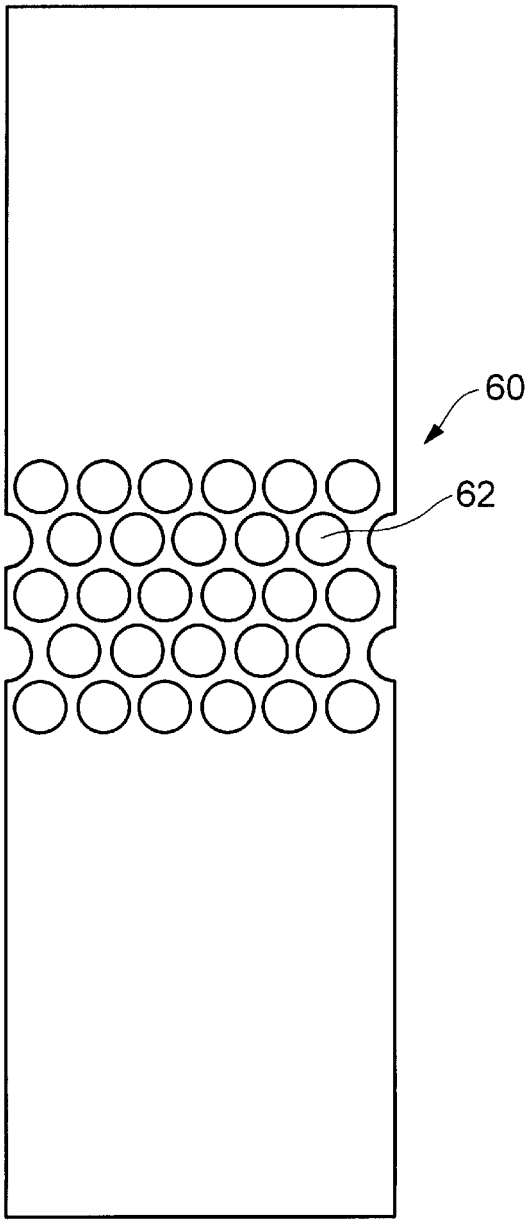
FIG. 5 is a plan view of fuse element having another alternative perforation pattern.

As shown in FIGS. 4 and 5, a fuse element 50, 60, in accordance with the invention may be provided with rectangular 52 or round 62 perforations arranged in rows so that the perforations are relatively alternately staggered or offset. Elongated, narrowed conductive pathways are formed by the perforations, similar to those described in connection with FIG. 1, although having a somewhat different shape. The fuse elements 50, 60 may also be encased in an electrically nonconducting coating as described above.

The fuse element 20 may be provided with terminals for connecting it in a circuit, in any suitable manner. For example, the fuse element 20 may be disposed in a glass cylinder with ferrule end terminals contacting the opposite end portions. Alternatively, terminal leads may be attached to the opposite end portions and the fuse element injection molded in a plastic material.

The following illustrative example is provided to show how a fuse element shown in FIG. 1 may be made according to the invention. A 0.015 thick strip of aluminum approximately 2 inches in length and 0.6 inches in width was prepared. A central portion 0.5 inches across was perforated by laser cutting to have a plurality of diamond-shaped perforations positioned in closely adjacent, staggered rows to form a lattice pattern. Spacing between rows measured as the axial distance between weak spots was 0.05 inches. Lateral spacing measured between weak spots along a line perpendicular to the axis was 0.075 inches. Branches having a width t (shown in FIG. 1) of about 0.02 inches were formed. As may be seen in FIG. 1, a shortest distance electrical pathway along the branches across the central portion takes a zig-zag route along adjacent perforations. The electrical pathway thus defined includes a plurality of weak spots, and adjacent zig-zag paths meet in weak spots at several points, except at the lateral sides of the central portion. The central portion was encased in an alumina ceramic overcoat injection molded on the central portion. Electrical terminations were attached to the opposite end portions for attaching the fuse element in a circuit.

The foregoing has described the preferred principles, embodiments and modes of operation of the present invention; however, the invention should not be construed as limited to the particular embodiments discussed. Instead, the above-described embodiments should be regarded as illustrative rather than restrictive, and it should be appreciated that variations, changes and equivalents may be made by others without departing from the scope of the present invention as defined by the following claims.

What is claimed is:

1. A fuse element for an overcurrent protection device, comprising:

a metallic strip element having a central portion and opposite end portions, said central portion having a plurality of perforations arranged in a plurality of rows defining a grid pattern of a plurality of metallic branches interconnected to provide a plurality of weak spots across said central portion, wherein branches connecting across the central portion provide a plurality of electrically conductive pathways across said center portion, each pathway having a length greater than an axial length of said center portion and wherein a total area of the branches and weak spots is less than a total area of the perforations; and, a heat absorbing coating encasing said central portion.

2. The fuse element as claimed in claim 1, wherein the coating comprises an electrically non-conducting ceramic material molded on the central portion.

3. The fuse element as claimed in claim 2, wherein the coating comprises a ceramic material selected from the group comprising alumina, zirconia and boron nitride.

4. The fuse element as claimed in claim 1, wherein the coating comprises an electrically non-conducting plastic material molded on the central portion.

5. The fuse element as claimed in claim 4, wherein the coating comprises a polyurethane material.

6. The fuse element as claimed in claim 1, wherein the coating is formed to substantially completely encase the fuse element in and around the perforations.

7. The fuse element as claimed in claim 1, wherein the perforations are diamond shaped and arranged to define a lattice pattern.

8. The fuse element as claimed in claim 1, wherein the perforations are circular.

9. The fuse element as claimed in claim 1, wherein the perforations are rectangular and are positioned in a staggered arrangement.

10. A fuse element for a high voltage direct current fuse, comprising a metallic strip having a central portion and opposite end portions, said central portion having a plurality of diamond-shaped perforations arranged in a plurality of proximate rows defining a grid having a plurality of branches meeting at a plurality of weak spots through which electric current flows to traverse said central portion, wherein connecting branches define a plurality of zigzag pathways across said central portion, each pathway having a length greater than an axial distance across said central portion.

11. The fuse element as claimed in claim 10, further comprising a coating encasing the central portion so that the coating substantially completely contacts the fuse element in and around the perforations.

12. The fuse element as claimed in claim 11, wherein the coating comprises an electrically non-conducting ceramic material molded on the central portion.

13. The fuse element as claimed in claim 12, wherein the coating comprises a ceramic material selected from the group comprising alumina, zirconia and boron nitride.

14. The fuse element as claimed in claim 11, wherein the coating comprises an electrically non-conducting plastic material molded on the central portion.

15. The fuse element as claimed in claim 14, wherein the coating is a polyurethane material.

16. The fuse element as claimed in claim 11, wherein the coating is formed of a heat-absorbing material.

* * * * *